United States Patent [19]

Balland

[11] Patent Number: 4,547,196

[45] Date of Patent: Oct. 15, 1985

[54] PROCESS FOR FIXING DIRECT AND REACTIVE DYESTUFFS ON CELLULOSIC FIBERS WITH ADDITION OF MAGNESIUM SALT AND ZIRCONIUM SALT TO FIXING AGENT

[75] Inventor: Jean Balland, Chateaurenault, France

[73] Assignee: Societe Anonyme dite Manufacture de Produit Chimiques Protex, Paris, France

[21] Appl. No.: 579,703

[22] Filed: Feb. 13, 1984

[30] Foreign Application Priority Data

Feb. 11, 1983 [FR] France ..... 83 02873

[51] Int. Cl.[4] ..... D06P 5/10; D06P 1/67; D06P 3/66

[52] U.S. Cl. ..... 8/496; 8/543; 8/618; 8/680; 8/918

[58] Field of Search ..... 8/618, 496

[56] References Cited

U.S. PATENT DOCUMENTS

| | | | |
|---|---|---|---|
| 4,410,652 | 10/1983 | Robinson et al. | 8/496 |
| 4,436,524 | 3/1984 | Valenti | 8/551 |
| 4,439,203 | 5/1984 | Runyon et al. | 8/496 |
| 4,439,208 | 3/1984 | Moser et al. | 8/556 |
| 4,443,223 | 4/1984 | Kissling et al. | 8/496 |
| 4,452,606 | 6/1984 | van Diest et al. | 8/496 |
| 4,475,918 | 10/1984 | Kissling et al. | 8/495 |

*Primary Examiner*—A. Lionel Clingman

*Attorney, Agent, or Firm*—Karl F. Ross; Herbert Dubno

[57] ABSTRACT

A process is disclosed for fixing direct and reactive dyestuffs on cellulosic fibers. According to the process, a zirconium salt is added to a conventional fixating agent, especially the condensation product of formaldehyde with a compound containing as part of the molecule at least one amino group.

9 Claims, No Drawings

PROCESS FOR FIXING DIRECT AND REACTIVE DYESTUFFS ON CELLULOSIC FIBERS WITH ADDITION OF MAGNESIUM SALT AND ZIRCONIUM SALT TO FIXING AGENT

FIELD OF THE INVENTION

The present invention relates to a process for the fixation of direct and reactive dyestuffs on cellulosic fibers.

BACKGROUND OF THE INVENTION

It is known in the art that it is generally not possible to obtain high color fastness when the dyeing of cellulosic fibers with direct dyes is concerned. One utilizes, quite frequently, to improve the fastness of the dyestuff, a number of conventional fixating agents.

The problem is frequently the same when using the reactive dyes and the utilization of the dye and the fixating agent interfere with one another, especially in the case where a soap treatment, following the dyeing is insufficient to eliminate all of the dye that is not fixed. The dye that is not fixed is responsible for insufficient color fastness under humid conditions.

A number of compounds have been proposed to improve the color fastness of the dyestuffs, direct or reactive. Most frequently the products of condensation of formaldehyde with compounds containing at least one amino group, such as the products of condensation of formaldehyde with guanidine, amino-triazine, amino-guanidine, dicyanodiamidine, biguanidine, and especially dicyanodiamide are employed.

Equally recommended, is the addition to the fixating agent, of salts of various metals, with the object of improving color fastness. These metals include salts of copper, chromium or aluminum.

In each case the application of a fixating agent is carried out following dyeing, according to a conventional process carried out by immersion in a bath for a long time, or in a continuous or semicontinuous fashion.

The application of the fixating agent can be carried out during the course of a finishing operation, particularly during the course of treatments carried out by the aid of thermosetting agents added to modify the physical characteristics of the article. In this case, a strengthening of the ability of the fixating agent to improve color fastness is observed.

OBJECT OF THE INVENTION

The object of the invention is to improve fixating ability of fixating agents conventionally used in dyeing processes, employing either direct or reactive dyes for cellulosic fibers.

SUMMARY OF THE INVENTION

The applicant has observed, in the course of his studies, that the employment of zirconium salts permits the strengthening of the fixating ability of the fixating agents.

The improvement manifests itself in the application of either direct dyes or reactive dyes.

The improvement manifests itself in a most important fashion when the fixation is carried out during the course of a finishing treatment with the aid of thermosetting agents. In this case the use of the zirconium salts permits an increase in the general level of the color fastness of the dyes and contributes equally favorably to the polymerization process of the resin deposited on the fibers.

In dyeing applications of direct dyes, the conditions of the present invention permit improvement in the color fastness under humid conditions, such as during washing, rinsing and sweating etc.

In dyeing applications of reactive dyes, there appears to be the possibility of omitting the washing operation or the usual soap treatment practiced following dyeing while maintaining a high level of color fastness. This possibility allows an important economic advantage in the application of a reactive dyestuff. Among the observed advantages, one can for example cite a highly elevated dye yield, leading to an important saving in the dyestuff, a reduction in pollution by waste water, as well as a saving of time, water steam, or other products usually necessary to carry out the washing operation.

The present invention is directed to a fixation process for dyes prepared from direct or reactive dyestuffs, for cellulosic fibers, according to which one adds zirconium salts to the fixating agents.

According to the invention, these fixating agents are those used to improve the color fastness of direct or reactive dyestuffs, for example, the condensation products of formaldehyde with compounds containing at least one amino group, such as the condensation products of formaldehyde and guanidine, amino-triazine, amino-guanidine, dicyanodiamidine, biguanidine, and dicyanodiamidine.

According to one feature of the invention, the zirconium salt is zirconium oxychloride.

The fixating process according to the invention is, in the case of the reactive dyestuffs, advantageously carried out directly after dyeing, without an intermediate washing operation.

It is equally possible to carry out simultaneously, the fixation of the dyes and the finishing of the cloth, the utilization of the zirconium salts contributing equally in the case of the polymerization process put into practice.

The resins used are those actually known and utilized for permanently finishing cellulosic articles, such as resins based on urea-formaldehyde, melamine-formaldehyde, glyoxal-carbamate, etc.

According to the invention, the quantity of the fixating agent may vary according to the exigencies of the article considered, the quantity being between 0.1 and 50% by weight ratio that of the cellulosic fiber and preferably between 1 and 5% by weight of the weight of the cellulosic fiber.

The quantity of the zirconium salt introduced is equally a function of the results desired. The quantity may vary between 1 and 95% by weight of the quantity of the fixating agent introduced, and preferably between 20 and 40%.

According to the invention, the dyeing of the cellulosic fibers is carried out according to the process of conventional dyeing, actually known, the fixation is carried out following dyeing according to an impregnation procedure, followed by dyeing.

EXAMPLE 1

A cotton cloth, previously bleached and hydrophilized, is dyed by the aid of a direct dyestuff whose reference in the Color Index is Blue Direct 78.

The dyeing is carried out exhaustively according to the conventional process at a temperature of 95° C. in the presence of sodium chloride.

After dyeing, rinsing is carried out with cold water, then the cloth obtained is dried.

Next the fixation of the coloring obtained is carried out while operating under the following conditions:

One impregnates by pad-dyeing a part of the sample in the bath under the following conditions:

10 g/l of a fixating agent produced from the condensation of formaldehyde and dicyanodiamide.

1 g/l of 80% acetic acid.

The impregnation is carried out at a temperature of 20° C. One expresses between the rolls of a pad-roller, the quantity of bath obtained in such a fashion that 80% by weight of the impregnation bath remains in the fiber. Next an immediate drying of the fiber is carried out on a ream for 2 minutes at a temperature of 120° C.

A second sample is treated under identical conditions except that added to the bath of impregnation are 2 g/l of zirconium oxychloride.

Next one proceeds with sample cloths in order to measure the color fastness during washing, carried out at 60° and 95° C., according to the tests described in La Norme Francaise NFG 07.015.

Washing at 60° C.

The sample is placed in a 500 ml vessel and the necessary quantity of soap solution is added along with sodium carbonate, preferably heated to 60° C.±2° in such a fashion as to obtain a ratio of 50 ml of solution to 1 g of textile material. The vessel is then affixed to the wheel of a washing machine and the wheel is turned for 30 minutes in a bath employing a temperature of 60° C.±2° at a rate of 40 tr/mn±2 tr/mn.

Washing at 95° C.

The sample is placed in a 500 ml vessel with 10 stainless steel balls and the necessary quantity of soap solution is added, along with sodium carbonate, preferably heated to 95° C.±2° C. in such a manner as to obtain a ratio of 50 ml of solution for 1 gram of textile material. The vessel is then affixed to the wheel of a washing machine and the wheel is turned for 30 minutes in a bath having a temperature of 95° C.±2°, at a rate of 40 tr/mn±2 tr/mn.

It is observed following the two series of tests, that an elevated color fastness results when the dye is fixed in the presence of a salt of zirconium. The following data were obtained:

| | wash at 60° C. | wash at 95° C. |
|---|---|---|
| Sample not fixed | 1–2 | 1 |
| Sample fixed without zirconium salt | 3–4 | 2 |
| Sample fixed with zirconium salt | 4–5 | 3–4 |

note 1 is the poorest dye fixing, 5 is the best.

EXAMPLE 2

The same conditions used in Example 1 are employed.

The fixation is carried out with the aid of a fixating agent prepared by the condensation of biguanidine with formaldehyde.

As in Example 1, it is observed, that there is an improvement in color fastness during washing when the fixation is accomplished in the presence of a zirconium salt.

EXAMPLE 3

A piece of cotton fabric, previously bleached and hydrolized is dyed through the use of a reactive dye, known as Blue Reactive 3 according to the Color Index.

The dyeing is carried out according to the conventional Pad-Therm process, that is the thermal, roller treatment.

After dyeing, the sample obtained is divided into three parts and next the following operation is carried out.

A. The sample is rinsed in cold water, then in hot water and finally given a soap treatment for 5 minutes at 80° C.

B. The sample is rinsed rapidly in cold water, then the sample is treated with pad-rollers in a bath having the following composition:

20 g/l of a fixating agent prepared by the condensation of formaldehyde with dicyanodiamide 2 g/l of 80% acetic acid The impregnation is carried out at a temperature of 20° C. Next the sample is expressed between the rollers of a pad-roller apparatus, in such a fashion as to retain 80% of the impregnation bath within the fiber, then drying takes place on a ream for two minutes at 120° C.

C. The same conditions as employed in B above are maintained, after having added to the fixation bath, 5 g/l of zirconium oxychloride.

It is noted after treatment, that the color intensity of Samples B and C is 25% higher than that of Sample A.

After measuring the color fastness during washing at 60° C. and 95° C., it is verified that an elevated color fastness is obtained in a sample subjected to the fixation process in the presence of a zirconium salt.

EXAMPLE 4

A piece of cotton fabric, previously bleached, is dyed and hydrolyzed by the use of a reactive dye known as Blue Reactive 137 according to the Color Index.

The dyeing is carried out according to the conventional Pad Stream process which employs pad-rollers and steaming.

After dyeing a finishing process according to the conditions of Example 3 is carried out.

It is observed, following treatment, a color yield very much elevated over that of the samples having been conventionally fixed.

The color fastness test during washing at 60° and 95° C. equally shows an elevated color fastness when treated in the presence of a zirconium salt.

EXAMPLE 5

A piece of cotton cloth is dyed according to the conditions in Example 3. After dyeing, the following operations are carried out:

Sample A

The sample is rinsed with cold water, then with hot water, then subjected to a soaping treatment at a temperature of 80° C. Then one impregnates the sample with a bath of the following composition, in order to achieve a permanent finishing.

100 g/l of an aqueous solution of 50% of DMDHEU (dimethyloldihydroxyethylene urea), and 7 g/l of magnesium chloride.

After impregnation by the pad-roller process, especially between the rollers of a pad-roller apparatus in such a way that 80% by weight of the impregnation bath is retained, the sample is then subjected to a thermal treatment for 3 minutes at 150° C.

Sample B

The sample is rinsed rapidly in cold water, then the process is carried out without washing in hot water without a soap treatment, and then finished according to the conditions of treatment for Sample A.

Sample C

The same procedures used in treating Sample B are employed, except that 20 g/l of a fixating agent prepared by the condensation of formaldehyde with dicyanodiamide are introduced into the resin bath.

Sample D

The same procedures employed in the treatment of Sample C are used, except that 5 g/l of zirconium oxychloride are introduced into the resin bath in addition to the fixating agent.

The results obtained according to each tested sample are summarized hereinafter:

| COLOR INTENSITY | |
|---|---|
| Sample A | 65% |
| Sample B | 85% |
| Sample C | 85% |
| Sample D | 85% |

The dye content of the water removed after the rinse bath after dyeing was as follows:

| | |
|---|---|
| Sample A | elevated |
| Sample B | low |
| Sample C | low |
| Sample D | low |

| | Color Fastness During Washing | |
|---|---|---|
| | 60° C. | 95° C. |
| Sample A | 5 | 5 |
| Sample B | 3–4 | 3 |
| Sample C | 4–5 | 3–4 |
| Sample D | 5 | 5 |

The following is a list of the color intensities of each of the samples treated as described hereinabove followed by a washing at 80° C.:

| | |
|---|---|
| Sample A | 60% |
| Sample B | 60% |
| Sample C | 70% |
| Sample D | 85% |

Accordingly it can be seen that after all of the process steps have been carried out, the use of the zirconium salts in the fixation process permits an improvement in color fastness and eventually in color intensity of the order of 15%.

I claim:

1. In a process for the fixation of a dye wherein a direct or reactive dyestuff is used to dye cellulosic fibers and wherein a magnesium salt is employed during the fixation process, the improvement which comprises the step of adding to a conventional fixating agent, a zirconium salt present in an amount of between 1 and 95% by weight of the fixating agent.

2. The improvement defined in claim 1 wherein the conventional fixating agent is a condensation product of formaldehyde and a compound containing at least one amino group.

3. The improvement defined in claim 1 wherein the compound containing at least one amino group is selected from the group which consists of guanidine, amino-triazine, dicyanodiamidine, biguanidine, and dicyanodiamide.

4. The improvement defined in claim 1 wherein the zirconium salt is zirconium oxychloride.

5. The improvement defined in claim 1 employing a reactive dyestuff wherein the fixation is carried out directly after dyeing without any intermediate washing.

6. The improvement defined in claim 1 wherein the fixation is carried out simultaneously with a finishing treatment using a thermohardenable resin.

7. The improvement defined in claim 1 wherein the quantity of the conventional fixating agent employed is between 0.1 and 50% by weight of the fiber.

8. The improvement defined in claim 7 wherein the quantity of the conventional fixating agent employed is between 1 and 5% by weight of the cellulosic fibers.

9. The improvement defined in claim 1 wherein the quantity of the zirconium salt is between 20 and 40% by weight of the quantity of the fixating agent.

* * * * *